US005496676A

United States Patent [19]

Croucher et al.

[11] Patent Number: 5,496,676

[45] Date of Patent: Mar. 5, 1996

[54] TONER AGGREGATION PROCESSES

[75] Inventors: Melvin D. Croucher, St. Catharines; Raj D. Patel, Oakville; Grazyna E. Kmiecik-Lawrynowicz, Burlington; Michael A. Hopper, Toronto, all of Canada; Bernard Grushkin, Pittsford, N.Y.

[73] Assignee: Xerox Corporation, Stamford, Conn.

[21] Appl. No.: 411,196

[22] Filed: Mar. 27, 1995

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,308,734 | 5/1994 | Sacripante et al. | 430/137 |
| 5,346,797 | 9/1994 | Kmiecik-Lawrynowicz et al. | 430/137 |

*Primary Examiner*—Roland Martin
*Attorney, Agent, or Firm*—E. O. Palazzo

[57] ABSTRACT

A process comprising:

(i) preparing a pigment dispersion comprised of pigment, ionic surfactant, and optional charge control agent;

(ii) mixing at least two resins in the form of latexes, each latex comprising a resin, ionic and nonionic surfactants and optionally a charge control agent, and wherein the ionic surfactant has a countercharge to the ionic surfactant of (i) to obtain a latex blend;

(iii) shearing said pigment dispersion with the latex blend of (ii) comprised of resins, counterionic surfactant with a charge polarity of opposite sign to that of said ionic surfactant and a nonionic surfactant;

(iv) heating the above sheared blends of (iii) below about the glass transition temperature (Tg) of the resin, to form electrostatically bound toner size aggregates with a narrow particle size distribution; and (v) subsequently adding further anionic surfactant solution to minimize further growth of the bound aggregates (vi);

(vi) heating said bound aggregates above about the glass transition temperature Tg of the resin to form stable toner particles; and optionally (vii) separating and drying the toner.

48 Claims, No Drawings

TONER AGGREGATION PROCESSES

BACKGROUND OF THE INVENTION

The present invention is generally directed to toner processes, and more specifically, to aggregation and coalescence processes for the preparation of toner compositions. In embodiments, the present invention is directed to the economical preparation of toners without the utilization of the known pulverization and/or classification methods, and wherein in embodiments toner compositions with an average volume diameter of from about 1 to about 25, and preferably from 1 to about 10 microns and narrow GSD of, for example, from about 1.16 to about 1.26 as measured on the Coulter Counter can be obtained. The resulting toners can be selected for known electrophotographic imaging, printing processes, including color processes, and lithography. In embodiments, the present invention is directed to a process comprised of dispersing a pigment and optionally toner additives like a charge control agent or additive in an aqueous mixture containing an ionic surfactant in an amount of from about 0.5 percent (weight percent throughout unless otherwise indicated) to about 10 percent and shearing this mixture with a latex blend comprised of suspended submicron resin particles of from, for example, about 0.01 micron to about 2 microns in volume average diameter in an aqueous solution containing a counterionic surfactant in amounts of from about 1 percent to about 10 percent with opposite charge to the ionic surfactant of the pigment dispersion, and nonionic surfactant in amounts of from about 10 percent to about 5 percent, thereby causing a flocculation of resin particles, pigment particles and optional charge control agent, followed by heating at about 5° to about 40° C. below the resin Tg and preferably about 5° to about 25° C. below the resin Tg while stirring of the flocculent mixture, which is believed to form statically bound aggregates of from about 1 micron to about 10 microns in volume average diameter comprised of resin, pigment and optionally charge control particles, and thereafter heating the formed bound aggregates above about the Tg (glass transition temperature) of the resin. The present invention in embodiments is directed to a process for the preparation of toner compositions comprising:

(i) preparing a pigment dispersion, which dispersion is comprised of a pigment, an ionic surfactant, and optionally a charge control agent;

(ii) preparing a blend of at least two, or two or more latexes, each comprised of resin, ionic and nonionic surfactants where the ionic surfactant possesses countercharging behavior to that of the ionic surfactant employed in step (i) either by a polytron or a ordinary mixer for 0.5 to 2 minutes to obtain a latex blend;

(iii) shearing the pigment dispersion with the above mixture of emulsion blend (ii) comprised of resin, a counterionic surfactant with a charge polarity of opposite sign to that of said ionic surfactant and a nonionic surfactant;

(iv) heating the above sheared blends below about the glass transition temperature (Tg) of the resin to form electrostatically bound toner size aggregates with a narrow particle size distribution;

(v) subsequently adding further anionic surfactant solution to minimize further growth in the coalescence step (vi); and (vi) heating said bound aggregates above about the Tg of the resin.

With the processes of the present invention, there can be obtained in embodiments small size diameter toner particles of, for example, from about 4 to about 7 microns in average volume diameter, and narrow controlled GSD of, for example, from about 1.18 to about 1.27; high or low gloss images; and matte images. An image is considered to be glossy when, for example, a value of 40 and above Gardiner gloss unit (ggu) is achieved at any given fusing temperature, while an image is considered to be matte when a value of 35 and below ggu is obtained, at any given fusing temperature.

The size of the aforementioned statistically bonded aggregated particles can be controlled, for example, by adjusting the temperature in the below the resin Tg heating stage. An increase in the temperature causes an increase in the size of the aggregated particle. This process of aggregating submicron latex and pigment particles is kinetically controlled, that is the temperature increases the process of aggregation. The higher the temperature during stirring, the quicker the aggregates are formed, for example from about 2 to about 10 times faster in embodiments. The temperature can also control in embodiments the particle size distribution of the aggregates, for example the higher the temperature, the narrower the particle size distribution, and this narrower distribution can be achieved in, for example, from about 0.5 to about 24 hours and preferably in about 1 to about 3 hours time. Heating the mixture about above or in embodiments equal to the resin Tg generates toner particles with, for example, an average particle volume diameter of from about 1 to about 25 and preferably 10 microns. It is believed that during the heating stage, the components of aggregated particles fuse together to form composite toner particles. In another embodiment thereof, the present invention is directed to an in situ chemical process comprised of first dispersing a pigment, such as HELIOGEN BLUE™ or HOSTAPERM PINK™, in an aqueous mixture containing a cationic surfactant, such as benzalkonium chloride (SANIZOL B-50™), utilizing a high shearing device, such as a Brinkmann Polytron, microfluidizer or sonicator, or using predispersed pigments like SUNSPERSE BLUE™, SUNSPERSE MAGENTA™ which is mixed by agitation in an aqueous media containing the cationic surfactant, thereafter shearing this mixture with a blend of latexes which are either compatible or incompatible; examples of compatible latexes is one latex of poly(styrene butadiene acrylic acid) and another second latex of poly(styrene butadiene acrylic acid) having a different molecular composition, for example a more or less butyl acrylate in the copolymer, a different molecular weight or a differing Tg to that of the first latex, or a system of latexes prepared from poly(styrene butylacrylate acrylic acid) and another latex of poly(styrene butylacrylate acrylic acid) of differing molecular composition, molecular weight or Tg to that of the first latex; an example of incompatible latex blend is a system comprised of poly(styrene butadiene acrylic acid) as one latex and poly(styrene butylacrylate acrylic acid) as a second latex; these resins phase separate when heated together into domains rich in each resin; an aqueous surfactant mixture containing an anionic surfactant, such as sodium dodecylbenzene sulfonate, for example NEOGEN R™ or NEOGEN SC™, and a nonionic surfactant such as alkyl phenoxy poly(ethylenoxy)ethanol, for example IGEPAL 897™ or ANTAROX 897™, and heating thereby resulting in a flocculation, or heterocoagulation of the resin particles with the pigment particles; where the size of the aggregated particles and their distribution can be controlled by the temperature of heating, for example from about 5° to about 25° C. below the resin Tg; and where the speed at which toner size aggregates are formed can also be controlled by the temperature. Thereafter, heating from about 5° to about 50° C. above the resin Tg provides for particle fusion or coalescence of the polymer and pigment particles; followed by optional washing and drying whereby toner particles comprised of resin and pigment with various particle size diameters can be obtained, such as from 1 to about 20. The aforementioned toners are especially useful for the development of colored images with excellent line and solid resolution, and wherein substantially no background deposits are present, and paper coating is avoided or minimized.

While not being desired to be limited by theory, it is believed that the flocculation or heterocoagulation is caused by the neutralization of the pigment mixture containing the pigment and ionic, such as cationic, surfactant absorbed on the pigment surface with the resin mixture containing the resin particles and anionic surfactant absorbed on the resin particle. The latex blend or emulsion is comprised of resin polymer, counterionic surfactant, and nonionic surfactant.

Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention. It is preferable to use small toner particle sizes such as from about 1 to about 7 microns and with higher pigment loading, such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss or matte image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns and fixing thereafter, results in a low gloss toner image of from about 1 to about 30 gloss units as measured by the Gardner Gloss metering unit. Alternatively, when higher image gloss is desired, such as from about 40 to about 80 gloss units as measured by the Gardner Gloss metering unit, higher gloss paper is utilized, such as from about 40 to about 80 gloss units, and which after image formation with small particle size toners of the present invention of preferably from about 3 to about 5 microns and fixing thereafter results in a higher gloss toner image of from about 40 to about 80 gloss units as measured by the Gardner Gloss metering unit. The aforementioned toner to paper matching can be attained with small particle size toners, such as less than 7 microns and preferably less than 5 microns, such as from about 1 to about 4 microns, whereby the pile height of the toner layer or layers is considered low and acceptable.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 3 microns to about 9 microns, and preferably 5 microns are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, is used in the emulsion resin. The process of the '127 patent does not appear to utilize counterionic surfactant and flocculation processes, and does not appear to use a counterionic surfactant for dispersing the pigment, or a latex mixture. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus directed to the use of coagulants, such as inorganic magnesium sulfate, which results in the formation of particles with a wide GSD. Furthermore, the '488 patent does not, it appears, disclose the process of counterionic, for example controlled aggregation is obtained by changing the counterionic strength, flocculation. Similarly, the aforementioned disadvantages, for example poor GSD are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites.

Additionally, there is illustrated in U.S. Pat. No. 5,278,020, the disclosure of which is totally incorporated herein by reference, a process for the preparation of a toner composition comprising the steps of (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the nonpolar toner sized composite particles.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In U.S. Pat. No. 5,346,797, the disclosure of which is totally incorporated herein by reference, there is illustrated a process for the preparation of toner compositions comprising (i) preparing a pigment dispersion in water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles above the resin Tg to form said toner composition comprised of polymeric resin, pigment and optionally a charge control agent.

In U.S. Pat. No. 5,370,963, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In U.S. Pat. No. 5,344,738, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In copending patent application U.S. Ser. No. 083,157, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In copending patent application U.S. Ser. No. 082,741, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii)(a) continuously stirring and heating the above sheared blend to form electrostatically bound toner size aggregates; or (iii)(b) further shearing the above blend to form electrostatically bound well packed aggregates; or (iii)(c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In copending patent application U.S. Ser. No. 083,116, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) surfactant and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

There are a number of advantages of the present invention in that by blending latexes together one can select the best properties of each resin, such as gloss and fix, which otherwise is not readily obtainable. Another advantage of the present invention is one can vary the gloss and fix levels as required (within the limits of the individual latex properties) by adjusting the concentrations or proportions of each latex. The same principle is also applicable in obtaining glossy or matte finishes. For example, if resin A has a low molecular weight it would result in an excellent gloss but poor fix, while if resin B has a high molecular weight, then it would result in a poor gloss and excellent fix. By combining them, one can obtain unexpected excellent gloss and acceptable fix. Hence, by altering the quantity of each of the latexes used in the blend a toner with designed gloss and fix can be obtained. A toner with excellent gloss and fix characteristics can be formulated using a latex blend prepared from one latex with a single resin whose molecular weight and composition provides an aggregated toner which has high gloss but poor fix with a second latex that has acceptable fix and poor gloss; and wherein the latex blend would be comprised of between 80 and 98 percent of the high gloss inducing latex and between from about 2 to about 20 weight percent of the acceptable fix latex.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion, narrow GSD, and gloss or matte finish after development.

In a further object of the present invention there is provided a process for the preparation of toner compositions with an average particle volume diameter of from between about 1 to about 10 microns, and preferably from about 1 to about 7 microns, and with a narrow GSD of from about 1.2 to about 1.3 and preferably from about 1.17 to about 1.27 as measured by a Coulter Counter.

In a further object of the present invention there is provided a process for the preparation of toner compositions with certain properties such that acceptable gloss and excellent toner fix characteristics can readily be obtained.

In a further object of the present invention there is provided a process for obtaining glossy or matte finishes by altering the proportions of each of the latexes selected.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

In another object of the present invention there are provided toner processes wherein at least two latex mixtures are selected, and in embodiments wherein a first and second latex are selected, each with dissimilar resins.

These and other objects of the present invention are accomplished in embodiments by the provision of toners and processes thereof. In embodiments of the present invention, there are provided processes for the economical direct preparation of toner compositions by improved flocculation or heterocoagulation, and coalescence, and wherein the temperature of aggregation can be utilized to control or obtain the final toner particle size, that is average volume diameter, and wherein a mixture of blends is selected as indicated herein. More specifically, in embodiments of the present invention a pigment dispersion is sheared with a mixture of two or more latexes, each comprised of resin, ionic and nonionic surfactants, the ionic surfactant being of a counterionic type, or of opposite charge to the ionic surfactant used in the pigment dispersion preparation. Each latex is comprised of between 20 and 40 percent by weight of a polymeric resin formed by emulsion polymerization and between 0.2 and 2 percent by weight of ionic and nonionic surfactant with the remainder of the latex being water.

The latexes used in the latex blend may be comprised of various effective resin systems that can be formulated by emulsion polymerization including single polymers formed from a single monomer, copolymers and terpolymers, and wherein one latex is present in an amount, for example, of from about 40 to about 60 weight percent, and the second latex is present in an amount of from about 60 to about 40 weight percent. These include polymers such as poly(styrene-butadiene), poly(para-methyl styrene-butadiene), poly(meta-methyl styrene-butadiene), poly(alpha-methyl styrene-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly(styrene-butadieneacrylic acid), poly(styrene-butadiene-methacrylic acid), and the like. In particular, one latex for high gloss is comprised of styrene butylacrylate acrylic acid in the ratio of 88:12:2 pph (parts per hundred) having a resin Tg of 55.0° C. and a $M_w$ of 20,000 with an $M_n$ of 7,000 blended with a second latex for acceptable fixing comprised of styrene butylacrylate acrylic acid in the ratio of 88:12:2 pph having a resin Tg 70.0° C. and an $M_w$ of 44,000, with an $M_n$ of 15,500.

Latexes, such as those described above, are compatible with one, while if the second latex were to be styrene butadiene acrylic acid, then they would be incompatible. Preferred are compatible latexes in embodiments of the present invention.

Also, in embodiments the present invention is directed to processes for the preparation of toner compositions which comprise (i) preparing an ionic pigment mixture by dispersing a pigment such as carbon black like REGAL 330®, HOSTAPERM PINK™, or PV FAST BLUE™ of from about 2 to about 10 percent by weight of toner in an aqueous mixture containing a cationic surfactant such as dialkylbenzene dialkylammonium chloride like SANIZOL B-S0™ available from Kao or MIRAPOL™ available from Alkaril Chemicals, and from about 0.5 to about 2 percent by weight of water utilizing a high shearing device such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to a blend of two latexes comprised of an aqueous suspension of dissimilar resin particles, or resin with differing $M_w$ comprised of, for example, poly(styrene-butylacrylate), or poly(styrene-butadiene), and which resin particles are present in various effective amounts, such as from about 40 percent to about 98 percent by weight of the toner, and wherein the polymer resin latex particle size is from about 0.1 micron to about 3 microns in volume average diameter, and counterionic surfactant such as an anionic surfactant like sodium dodecylsulfate, dodecylbenzene sulfonate or NEOGEN R™ from about 0.5 to about 2 percent by weight of water, a nonionic surfactant, such as polyethylene glycol or polyoxyethylene glycol nonyl phenyl ether or IGEPAL 897™ obtained from GAF Chemical Company, from about 0.5 to about 3 percent by weight of water, thereby causing a flocculation or heterocoagulation of pigment, charge control additive and resin particles; (iii) diluting the mixture with water to enable from about 50 percent to about 15 percent of solids; (iv) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further stirring with a mechanical stirrer from about 250 to 500 rpm about below the resin Tg at, for example, about 5° to 15° C. below the resin Tg at temperatures of about 35 to 50° C. to form electrostatically stable aggregates of from about 0.5 micron to about 10 microns in average volume diameter; (v) adding additional anionic surfactant or nonionic surfactant in the amount of from 0.5 percent to 20 percent by weight of water to stabilize the aggregates formed in step (iv), heating the statically bound aggregate composite particles at from about 60° C. to about 105° C. for a duration of about 60 minutes to about 600 minutes to form toner sized particles of from about 3 microns to about 7 microns in volume average diameter and with a geometric size distribution of from about 1.2 to about 1.3 as measured by the Coulter Counter; and (vi) isolating the toner sized particles by washing, filtering and drying thereby providing composite toner particles comprised of resin and pigment. Flow additives to improve flow characteristics and charge additives, if not initially present, to improve charging characteristics may then be added by blending with the formed toner, such additives including AEROSILS® or silicas, metal oxides like tin, titanium and the like, metal salts of fatty acids like zinc stearate, and which additives are present in various effective amounts, such as from about 0.1 to about 10 percent by weight of the toner. The continuous stirring in step (iii) can be accomplished as indicated herein, and generally can be effected at from about 200 to about 1,000 rpm for from about 1 hour to about 24 hours, and preferably from about 6 to about 12 hours.

Various known methods can be selected for obtaining the pigment dispersion depending for example on the form of the pigment utilized. In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents such as the aforementioned ionic or nonionic surfactants.

In embodiments, the present invention relates to a process for the preparation of toner compositions with controlled particle size comprising:

(i) preparing a pigment dispersion in water, which dispersion is comprised of a pigment, an ionic surfactant and optionally a charge control agent;

(ii) mixing two or more latexes either by a polytron or a mixer for 0.5 to 2 minutes to obtain a blend;

(iii) shearing the pigment dispersion with the latex blend mixture comprised of resin particles, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids;

(iv) heating, for example, from about 35° to about 50° C. the sheared blend at temperatures below the about or equal resin Tg, for example from about 5° to about 20° C., while continuously stirring to form electrostatically bounded relatively stable (for Coulter Counter measurements) toner size aggregates with narrow particle size distribution;

(v) subsequently adding further anionic surfactant solution to minimize further growth in the coalescence step (vi)

(vi) heating, for example from about 60° to about 95° C., the statically bound aggregated particles of (iv) at temperatures of about 5° to 50° C. above the resin Tg of wherein the resin Tg is in the range of about 50°, preferably 52° to about 65° C. to enable a mechanically stable, morphologically acceptable toner composition comprised of solids of polymeric resin, pigment and optionally a charge control agent;

(vii) separating the toner particles from the water by filtration; and (viii) drying the toner particles.

Embodiments of the present invention include a process for the preparation of toner compositions with controlled particle size comprising:

(i) preparing a pigment dispersion in water, which dispersion is comprised of a pigment of a diameter of from about 0.01 to about 1 micron, an ionic surfactant, and optionally a charge control agent;

(ii) mixing a first and second different latex either by a polytron or an ordinary mixer for 0.5 to 2 minutes to obtain a blend;

(iii) shearing the pigment dispersion with a latex blend comprised of resin particles of submicron size of from about 0.01 to about 1 micron, a counterionic surfactant with a charge polarity, positive or negative, of opposite sign to that of said ionic surfactant and a nonionic surfactant thereby causing a flocculation or heterocoagulation of the formed particles of pigment, resin and charge control agent to form a uniform dispersion of solids in the water and surfactant system;

(iv) heating the above sheared blend at a temperature of from about 5° to about 20° C. below the Tg of the resin particles while continuously stirring to form electrostatically bound or attached relatively stable (for Coulter Counter measurements) toner size aggregates with a narrow particle size distribution;

(v) subsequently adding further anionic surfactant solution to minimize further growth in the coalescence step (vi)

(vi) heating the statically bound aggregated particles at a temperature of from about 5° to about 50° C. above the Tg of the resin to provide a mechanically stable toner composition comprised of polymeric resin, pigment and optionally a charge control agent;

(vii) separating the toner particles from the water by filtration; and (viii) drying the toner particles.

In embodiments, the heating in (iv) is accomplished at a temperature of from about 29° to about 59° C.; the resin Tg in (iv) is from about 50° to about 80° C.; heating in (vi) is from about 5° to about 50° C. above the Tg; and wherein the resin Tg in (vi) is from about 50° to about 80° C.

In embodiments, heating below the glass transition temperature (Tg) can include heating at about the glass transition temperature or slightly higher. Heating above the Tg can include heating at about the Tg or slightly below the Tg, in embodiments.

Illustrative examples of specific resin particles, resins or polymers selected for the process of the present invention include known polymers such as poly(styrene-butadiene), poly(para-methyl styrene-butadiene), poly(meta-methyl styrene-butadiene), poly(alpha-methyl styrene-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly(styrene-butadiene-acrylic acid), poly(styrene-butadienemethacrylic acid), and the like. The resin selected, which generally can be in embodiments styrene acrylates, styrene butadienes, styrene methacrylates, or polyesters, is present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resins selected for the process of the present invention are preferably prepared from emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional and such groups can be present in various amounts of from about 0.1 to about 10 percent by weight of the polymer resin. Known chain transfer agents, for example dodecanethiol, about 1 to about 10 percent, or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in copending application U.S. Ser. No. 921,165, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CBS600™, MCX6369™; Bayer magnetites, BAYFERROX 8600™, 8610™; Northern Pigments magnetites, NP-604™, NP-608™; Magnox magnetites TMB-100™, or TMB-104T™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™ and cyan components may also be selected as pigments with the process of the present invention. The pigments selected are present in various effective amounts, such as from about 1 weight percent to about 65 weight and preferably from about 2 to about 12 percent, of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to about 4, and preferably from about 0.5 to about 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from RhonePoulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregated comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

The following Examples also illustrate the compatible and the noncompatible blends of latexes.

EXAMPLES

Preparation of Latex A by Emulsion Polymerization [Low Molecular Weight Styrene-butyl Acrylate Latex]:

A latex was prepared by emulsion polymerization of styrene/butylacrylate and acrylic acid (82/18 styrene to butylacrylate with 2 parts per hundred acrylic acid) in a nonionic/anionic surfactant solution (3 percent surfactant) as follows. 352 Grams of styrene, 48 grams of butyl acrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 8 hours. The resulting latex, 60 percent water and 40 percent (weight percent throughout) solids, was comprised of a copolymer of poly(styrene-butylacrylate-acrylic acid), 82/18:2. The Tg of the dried latex sample was 55° C., as measured on a DuPont DSC; $M_w$=20,100, and $M_n$=7,000 as determined on Hewlett Packard GPC. The zeta potential as measured on Pen Kem Inc. Laser Zee Meter was −80 millivolts for the polymeric latex. The particle size of the latex as measured on Brookhaven BI-90 Particle Nanosizer was 147 nanometers. The aforementioned latex A was then selected for the toner preparation of Examples I and III.

Preparation of Latex B by Emulsion Polymerization [High Molecular Weight, High Tg, Styrene-butyl Acrylate Latex]:

A polymeric latex was prepared by the emulsion polymerization of styrene/butylacrylate/acrylic acid (88/12/2 parts) in nonionic/anionic surfactant solution (3 percent) as follows. 352 Grams of styrene, 48 grams of butyl acrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 8 hours. The resulting latex, 60 percent water and 40 percent (weight percent throughout) solids, was comprised of a copolymer of polystyrene/polybutyl acrylate/polyacrylic acid, 88/12/2. The Tg of the latex dry sample was 74° C., as measured on a DuPont DSC; $M_w$=47,500, and $M_n$=16,000 as determined on Hewlett Packard GPC. The zeta potential as measured on Pen Kem Inc. Laser Zee Meter was −80 millivolts for the polymeric latex. The particle size of the latex as measured on Brookhaven BI-90 Particle Nanosizer was 189 nanometers. The aforementioned latex was then selected for the toner preparation of Examples II and III.

Preparation of Latex C by Emulsion Polymerization [Low Molecular Weight Styrene-butadiene Latex]:

This latex resin was prepared by emulsion polymerization process as follows. The aqueous phase comprising 130.5 grams of NEOGEN® anionic surfactant, 124.7 grams of ANTAROX 897™ nonionic surfactant, and 8.7 kilograms of deionized water was charged into a 5 gallon stainless steel reactor and agitated at 200 rpm for 60 minutes. 58 Grams of potassium persulfate was then added to the reactor. The organic phase of 5,104 grams of styrene, 145 grams of dodecanethiol (chain transfer agent) and 116 grams of acrylic acid was charged into a monomer tank to which 696 grams of butadiene was under pressure. The organic phase of styrene/butadiene/acrylic acid (88/12/2 pph) was then transferred into the reactor under pressure. As the organic phase was mixed into the aqueous phase under agitation, an emulsion was formed, which was polymerized at 80° C. for a period of 6 hours. The reactor was then cooled down and the resin product was discharged into a 5 gallon pail. The $M_w$, $M_n$ and MWD of the above resin are measured using gel permeation chromatography. The resin was found to have a $M_w$ of 29,900, $M_n$ of 10,600 and a MWD of 2.81. The resin also had a Tg of 52° C.

Preparation of Latex D by Emulsion Polymerization [High Molecular Weight Styrene-butadiene Latex]:

The resin was prepared in a conventional emulsion polymerization process as follows. The aqueous phase comprising 130.5 grams of NEOGEN®anionic surfactant, 124.7 grams of ANTAROX 897™ nonionic surfactant, and 8.7 kilograms of deionized water was charged into a 5 gallon stainless steel reactor and agitated at 200 rpm for 60 minutes. 58 Grams of potassium persulfate was then added to the reactor. The organic phase consisting of 5,104 grams of styrene, 75 grams of dodecanethiol (chain transfer agent) and 116 grams of acrylic acid was charged into a monomer tank to which 696 grams of butadiene was under pressure. The organic phase of styrene/butadiene/acrylic acid (88/12/2 pph) was then transferred into the reactor under pressure. As the organic phase was mixed into the aqueous phase under agitation, an emulsion was formed which was polymerized at 80° C. for a period of 6 hours. The reactor was then cooled down and the product was discharged into a 5 gallon pail. The $M_w$ , $M_n$ and MWD of the resin produced were measured using gel permeation chromatography. The resin was found to have a $M_w$ of 98,000, $M_n$ of 13,900 and a MWD of 7. The resin also had a Tg of 64.0° C.

Preparation of Latex E by Emulsion Polymerization [Intermediate Molecular Weight Styrene-butadiene Latex]:

The resin was prepared in a conventional emulsion polymerization process as follows. The aqueous phase comprising 130.5 grams of NEOGEN® anionic surfactant, 124.7 grams of ANTAROX 897™ nonionic surfactant, and 8.7 kilograms of deionized water was charged into a 5 gallon stainless steel reactor and agitated at 200 rpm for 60 minutes. 58 Grams of potassium persulfate was then added to the reactor. The organic phase of 5,104 grams of styrene, 120 grams of dodecanethiol (chain transfer agent) and 116 grams of acrylic acid was charged into a monomer tank to which 696 grams of butadiene was under pressure. The organic phase of styrene/butadiene/acrylic acid (88/12/2 pph) was then transferred into the reactor under pressure. As the organic phase was mixed into the aqueous phase under agitation, an emulsion was formed which was polymerized at 80° C. for a period of 6 hours. The reactor was then cooled down and the product was discharged into a 5 gallon pail. The $M_w$ , $M_n$ and MWD of the resin produced were measured using gel permeation chromatography. The resin was found to have a $M_w$ of 58,000, $M_n$ of 11,100 and a MWD of 5.21. The resin also had a Tg of 53° C.

Fusing Performance Evaluation:

The fusing performance was evaluated using a Xerox 5675 fuser fitted with an adjustable temperature controlled fusing roll and temperature sensor. The gloss of a fused toner image at 1.2 grams/square centimeter toner coverage as a function of temperature was evaluated using a Gardner Gloss Meter. The hot offset temperature (HOT) was determined by noting the first sign of transfer of any toner from the paper to the fuser roll. The minimum fix temperature (MFT) was determined using a crease test which involves creasing the image under standard conditions and determining the extent of toner removal from the paper using image analysis of the creased area. The fix latitude was defined to be the difference between the HOT and the MFT. From the image analysis of the creased area, it was possible to determine whether the image showed a small single crack line or was more brittle and easily cracked. A single crack line in the creased area provided a "fracture coefficient" of unity while a highly cracked crease exhibited "fracture coefficients" greater than unity. The greater the cracking, the greater the fracture coefficient.

COMPARATIVE EXAMPLE I

Preparation of Toner Size Particles from Single Latex (EA-309):

6.7 Grams of dry SUNFAST BLUE™ pigment were dispersed in 200 milliliters of deionized water containing 1.46 grams of alkylbenzyldimethyl ammonium chloride cationic surfactant (5SANIZOL B™) using an ultrasonic probe for 2 minutes. The resulting pigment solution was then added to 300 grams of water containing 1.46 grams of cationic surfactant and stirred. This cationic dispersion of the pigment was then simultaneously added with 325 grams of Latex A to 300 grams of water while being homogenized with an IKA G45M probe for 3 minutes at 7,000 rpm. This mixture then was transferred into a reaction kettle and its temperature raised to 45° C. for a period of 2 hours. The particle size of the aggregate obtained was 5.3 microns with a GSD of 1.21 as measured by Coulter Counter. 60 Milliliters of 20 percent (W/W) anionic surfactant solution were added to the aggregates after which the reactor temperature was raised to 80° C. for 5 hours to complete the coalescence of the aggregates. The final particle size obtained was 5.3 microns with a GSD of 1.22. The particles were then washed with deionized water and freeze dried. The resulting cyan toner was comprised of 95 percent resin of poly(styrene-co-butylacrylate-coacrylic acid), and 5 percent of SUNFAST BLUE™ pigment. The resulting toner had an $M_w$ of 20,100, $M_n$ of7,100, and a Tg of 54.8° C. This cyan toner was examined for fusing performance and the results are provided below.

COMPARATIVE EXAMPLE II

Preparation of Toner Size Particles from Single Latex (EA-332):

6.7 Grams of dry SUNFAST BLUE ™ pigment were dispersed in 200 milliliters of deionized water containing 1.46 grams of alkylbenzyldimethyl ammonium chloride cationic surfactant (SANIZOL B™) using an ultrasonic probe for 2 minutes. The resulting pigment solution was then added to 300 grams of water containing 1.46 grams of cationic surfactant and stirred. This cationic dispersion of the pigment was then simultaneously added with 325 grams of Latex B above to 300 grams of water while being homogenized with an IKA G45M probe for 3 minutes at 7,000 rpm. This mixture then was transferred into a reaction kettle and its temperature raised to 55° C. for a period of 3 hours. The particle size of the aggregate obtained was 4.8 microns with a GSD of 1.21 as measured by Coulter Counter. 60 Milliliters of 20 percent (W/W) anionic surfactant solution were added to the aggregates, after which the reactor temperature was raised to 90° C. for 3 hours to complete the coalescence of the aggregates. The final particle size obtained was 5.0 microns with a GSD of 1.23. The particles were then washed with deionized water and freeze dried. The resulting cyan toner was comprised of 95 percent resin of poly(styrene-co-butylacrylate-co-acrylic acid), and 5 percent of SUNFAST BLUE™ pigment. The resulting toner had an $M_w$ of 43,800, $M_n$ of 15,500, and a Tg of 70.3° C. This cyan toner was examined for fusing performance and the results are provided below.

EXAMPLE III

Preparation of Toner Size Particles for Latex Blend (EA-331):

6.7 Grams of dry SUNFAST BLUE TM pigment were dispersed in 200 milliliters of deionized water containing 1.46 grams of alkylbenzyldimethyl ammonium chloride cationic surfactant (SANIZOL B™) using an ultrasonic probe for 2 minutes. The resulting pigment solution was then added to 300 grams of water containing 1.46 grams of cationic surfactant and stirred. This cationic dispersion of the pigment was then simultaneously added with 325 grams of a latex blend made by mixing Latexes A and B above (50 percent of Latex A and 50 percent of Latex B) to 300 grams of water while being homogenized with an IKA G45M probe for 3 minutes at 7,000 rpm. This mixture then was transferred into a reaction kettle and its temperature raised to 45° C. for a period of 1.5 hours. The particle size of the aggregate obtained was 4.2 microns with a GSD of 1.24 as measured by Coulter Counter. 60 Milliliters of 20 percent (W/W) anionic surfactant solution was added to the aggregates, after which the reactor temperature was raised to 90° C. for 3 hours to complete the coalescence of the aggregates. The final particle size obtained was 4.3 microns with a GSD of 1.25. The particles were then washed with deionized water and freeze dried. The resulting cyan toner was comprised of 95 percent resin of poly(styrene-co-butylacrylate-co-acrylic acid), and 5 percent of SUNFAST BLUE™ pigment. The resulting toner had an $M_w$ of 39,000, $M_n$ of 9,200, and a Tg of 63° C. This cyan toner was examined for fusing performance in accordance with the procedure illustrated herein.

TABLE 1

FUSING EVALUATION FOR LATEX TONERS

| Toner ID | Gloss Temp ($G_{40}$) | Hot Offset Temperature (°C.) | Fix Latitude (°C.) | Fracture Coefficient |
|---|---|---|---|---|
| 309 | 138 | 190 | 39 | 4.46 |
| 331 | 159 | 210 | 63 | 1.70 |
| 332 | 179 | >210 | >52 | 1.78 |

COMPARATIVE EXAMPLE IV

Preparation of Toner Particles from Single Latex (EA-524):

Latex C was formed into a toner by conventional aggregation of the resin with pigment particles. Specifically, the toner is produced by selecting 650 grams of the above Latex C and simultaneously adding with a pigment solution of 18 grams of predispersed pigment (BHD 6000), 600 grams of water and 5.85 grams of cationic surfactant (SANIZOL B ™) to 1,000 grams of water while being polytroned. The mixture was recirculated through a shearing device operating at speeds of 10,000 rpm at a gap setting of 2 millimeters for 8 minutes and builds up viscosity. At the end of the shearing, the mixture was transferred into a 4 liter reactor equipped with stirrer and agitated at 500 rpm. The aggregation was performed by raising the reactor temperature to 45° C. and held there for 3 hours. The particle size obtained was 3.8 microns with GSD of 1.22. 120 Milliliters of 20 percent (w/w) of aqueous anionic surfactant solution were added in order to retain the aggregate particle size through the coalescence step. The temperature was then further raised to 80° C. (coalescence step) and held there for a period of 6 hours. The particle size now obtained was 3.5 micron and a GSD of 1.22. The toner had an $M_w$ of 30,800, $M_n$ of 10,100, MWD of 3.06 and a Tg of 52.1° C. The cyan toner was evaluated for fusing performance and the results obtained are presented in Table 2.

COMPARATIVE EXAMPLE V

Preparation of Toner Particles from Sinclle Latex (EA-318):

Latex D was formed into a toner by conventional aggregation of the resin with pigment particles. Specifically, the toner was produced by taking 650 grams of the above latex and simultaneously added with a pigment solution consisting of 18 grams of predispersed pigment (BHD 6000), 600 grams of water and 5.85 grams of cationic surfactant (SANIZOL B™) to 1,000 grams of water while being polytroned. The mixture was recirculated through a shearing device running at speeds of 10,000 rpm at a gap setting of 2 millimeters for 8 minutes and built up viscosity. At the end of the shearing, the mixture was transferred into a 4 liter reactor equipped with stirrer and agitated at 500 rpm. The aggregation was performed by raising the reactor temperature to 45° C. and held there for 3 hours. The particle size obtained was 5.3 micron with GSD of 1.24. 120 Milliliters of 20 percent (w/w) of aqueous anionic surfactant solution was added in order to retain the aggregate particle size through the coalescence step. The temperature was then further raised to 90° C. (coalescence step) and held there for a period of 3 hours. The particle size obtained was 5.3 microns and a GSD of 1.25. The toner had an $M_w$ of 98,800, $M_n$ of 14,100, MWD of 7.0 and a Tg of 63° C. The fusing performance of the toner was evaluated and the results are summarized in Table 2 below.

EXAMPLE VI

Toner Preparation of Latex Blend ( EA-344-4):

7.8 Grams of BHD 6000 (40 percent solids) SUNSPERSE BLUE™ pigment were dispersed in 240 milliliters of deionized water containing 2.3 grams of alkylbenzyldimethyl ammonium chloride cationic surfactant (SANIZOL B™) by stirring. This cationic dispersion of the pigment was then simultaneously added to 260 grams of a blend of Latexes C and D above (50 percent of Latex C and 50 percent of Latex D) to 400 grams of water while being homogenized with an IKA G45M probe for 3 minutes at 7,000 rpm. This mixture then was transferred into a reaction kettle and its temperature raised to 45° C. for a period of 1.5 hours. The particle size of the aggregate obtained was 4.8 microns with a GSD of 1.23 as measured by Coulter Counter. 60 Milliliters of 20 percent (W/W) anionic surfactant solution was added to the aggregates, after which the reactor temperature was raised to 90° C. for 3 hours to complete the coalescence of the aggregates. The final particle size obtained was 4.9 microns with a GSD of 1.23. The particles were then washed with deionized water and freeze dried. The resulting cyan toner was comprised of 96.5 percent resin of poly(styrene-co-butylacrylate-co-acrylic acid), and 5 percent of SUNFAST BLUE™ pigment. The resulting toner had an $M_w$ of 56,000, $M_n$ of 10,100, and a Tg of 55° C. This cyan toner (344-4) was evaluated for fusing performance as described above and the results are presented in Table 2.

TABLE 2

FUSING EVALUATION OF STYRENE-BUTADIENE TONERS

| Toner ID | Mw (K) /Tg (°C.) | Gloss Temp ($G_{40}$) | Hot Offset Temperature | Fix Latitude (°C.) | Fracture Coefficient |
|---|---|---|---|---|---|
| 524 | 30.8/52 | 149 | 190 | 47 | 1.75 |
| 344-4 | 56/55 | 167 | >200 | >56 | 1.98 |
| 318 | 98/63 | 210 | >210 | >12 | 1.70 |

Examination of this table suggests that the blend of latexes produces a toner with characteristics that are situated between the toners made from the individual latexes. This indicates that a latex blend can be formulated to meet a desired behavior that is situated between the two extremes by mixing two specified latexes in appropriate proportion.

EXAMPLE VII

Toner Preparation with Latex A and Latex E Blend (EA-326-3):

7.8 Grams of BHD 6000 (40 percent solids) SUNSPERSE BLUE™ pigment were dispersed in 240 milliliters of deionized water containing 2.3 grams of alkylbenzyldimethyl ammonium chloride cationic surfactant (SANIZOL B™) by stirring. This cationic dispersion of the pigment was then simultaneously added with 260 grams of a blend of Latex A and Latex E (50 percent Latex A and 50 percent Latex E) to 400 grams of water while being homogenized with an IKA G45M probe for 3 minutes at 7,000 rpm. This mixture then was transferred into a reaction kettle and its temperature raised to 45° C. for a period of 1.5 hours. The particle size of the aggregate obtained was 4.8 microns with a GSD of 1.23 as measured by Coulter Counter. 60 Milliliters of 20 percent (W/W) anionic surfactant solution were added to the aggregates, after which the reactor temperature was raised to 90° C. for 3 hours to complete the coalescence of the aggregates. The final particle size obtained was 4.9 microns with a GSD of 1.23. The particles were then washed with deionized water and freeze dried. The resulting cyan toner was comprised of 96.5 percent resin of poly(styrene-co-butylacrylate-co-acrylic acid), and 5 percent of SUNFAST BLUE™ pigment. The resulting toner had an $M_w$ of 56,000, $M_n$ of 10,100, and a Tg of 55° C. This cyan toner (326-3) was evaluated for fusing performance along with a toner prepared from the individual latexes viz. Latex A (EA - 309) as above and Latex E (EA-2-1) the fusing results are summarized in Table 3.

TABLE 3

FUSING RESULTS OF EA-309, 326-3, AND EA-2-1

| Toner ID | Gloss Temp ($G_{40}$) | Hot Offset Temperature (°C.) | Fix Latitude (°C.) | Fracture Coefficient |
|---|---|---|---|---|
| 309 | 138 | 190 | 39 | 4.46 |
| 326-3 | 164 | 200 | 55 | 1.82 |
| E-A 2-1 | 167 | >200 | >58 | 1.98 |

Examination of this Table indicates that sample 309 has a gloss 40 temperature ($G_{40}$) of 138° C. while E-A 2-1 has a gloss 40 temperature ($G_{40}$) of 167° C. The blend of the latexes, sample 326-3, appears to assume the characteristics of EA - 2-1 rather than being of intermediate between EA-2-1 and 309.

Other embodiments and modifications of the present invention may occur to those skilled in the art subsequent to a review of the information presented herein; these embodiments and modifications, as well as equivalents thereof, are also included within the scope of this invention.

What is claimed is:

1. A process comprising:

(i) preparing a pigment dispersion comprised of pigment, ionic surfactant, and optional charge control agent;

(ii) mixing at least two resins of different molecular composition, molecular weight or Tg in the form of latexes, each latex comprising a resin, ionic and nonionic surfactants and optionally a charge control agent, and wherein the ionic surfactant has a countercharge to the ionic surfactant of (i) to obtain a latex blend;

(iii) shearing said pigment dispersion with the latex blend of (ii) comprised of resins, counterionic surfactant with a charge polarity of opposite sign to that of said ionic surfactant and a nonionic surfactant;

(iv) heating the above sheared blends of (iii) below about the glass transition temperature (Tg) of the resins, to form electrostatically bound toner size aggregates with a narrow particle size distribution; and (v) subsequently adding further anionic surfactant solution to minimize further growth of the bound aggregates (vi);

(vi) heating said bound aggregates above about the glass transition temperature Tg of the resins to form stable toner particles; and optionally (vii) separating and drying the toner.

2. A process in accordance with claim 1 wherein one of said latexes employed in (ii) is comprised of styrene/butylacrylate/acrylic acid, styrene butadiene/acrylic acid, or styrene/isoprene/acrylic acid.

3. A process in accordance with claim 1 wherein a first and second latex are selected, and wherein the first latex is comprised of styrene/butylacrylate/acrylic acid, styrene/butadiene/acrylic acid, or styrene/isoprene/acrylic acid resin, which resin possesses a dissimilar molecular weight and/or a dissimilar glass transition temperature Tg than that of the second resin latex.

4. A process in accordance with claim 1 wherein the latexes selected are comprised of resins that are compatible evidencing substantially no phase separation, thus enabling a toner with high, of from about 40 to about 80 gloss, and excellent fixing characteristics.

5. A process in accordance with claim 1 wherein the latexes employed are comprised of resins that are incompatible resulting in a toner with low gloss, excellent fix, and wherein the toner formed enables images with a matte finish.

6. A process in accordance with claim 1 wherein one latex is comprised of styrene/butylacrylate acrylic acid, 82:18:2 parts per hundred, and a second latex is comprised of styrene/butylacrylate acrylic acid, 88:12:2 parts per hundred.

7. A process in accordance with claim 1 wherein one latex is present in an amount of from about 5 to about 95 weight percent and the second or latex is present in an amount of from about 95 to about 5 weight percent.

8. A process in accordance with claim 1 wherein one latex is present in an amount of from about 40 to about 60 weight percent and the second latex comprising the blend is present in an amount of from about 60 to about 40 weight percent.

9. A process in accordance with claim 1 wherein the toner that results has a narrow geometric size distribution of from about 1.18 to about 1.27, and the average volume particle diameter of the toner is from about 4 to about 7 microns.

10. A process in accordance with claim 1 wherein the heating (iii) at a temperature below the resin Tg enables the size of the aggregated particles to be in the range of from about 2.5 to about 10 microns in average volume diameter.

11. A process in accordance with claim 1 wherein the ionic surfactant utilized in preparing the pigment dispersion is a cationic surfactant, and the counterionic surfactants present in the latex mixtures are comprised of anionic surfactants.

12. A process in accordance with claim 1 wherein the ionic surfactant utilized in preparing the pigment dispersion is an anionic surfactant, and the counterionic surfactants present in the latex mixture are comprised of cationic surfactants.

13. A process in accordance with claim 1 wherein there are selected at least two latexes that are compatible.

14. A process in accordance with claim 1 wherein there are selected from 2 to about 10 latexes.

15. A process in accordance with claim 1 wherein the shearing or homogenization in (iii) is accomplished by homogenizing at from about 1,000 revolutions per minute to about 10,000 revolutions per minute for a duration of from about 1 minute to about 120 minutes.

16. A process in accordance with claim 1 wherein the heating of the blends of latex, pigment, surfactants and optional charge control agent in (iv) is accomplished at temperatures of from about 20° C. to about 5° C. below the Tg of the resin for a duration of from about 0.5 hour to about 6 hours.

17. A process in accordance with claim 1 wherein the heating of the statically bound aggregate particles to form toner size composite particles comprised of pigment, resin and optional charge control agent is accomplished at a temperature of from about 10° C. above the Tg of the resin to about 95° C. for a duration of from about 1 hour to about 8 hours.

18. A process in accordance with claim 1 wherein the resin for one of the latexes is selected from the group consisting of poly(styrene-butadiene), poly(para-methyl styrene-butadiene), poly(meta-methylstyrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methylstyrene-isoprene), poly(meta-methylstyrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), poly(butylacrylate-isoprene), poly(styrene-butadiene-acrylic acid), poly(styrene-butadiene-methacrylic acid), poly(styrene-butylmethacrylate-acrylic acid), and poly(styrene-butylacrylate-acrylic acid).

19. A process in accordance with claim 1 wherein the resin selected for a second latex is selected from the group consisting of poly(styrene-butadiene), poly(para-methyl styrene-butadiene), poly(meta-methylstyrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methylstyrene-isoprene), poly(meta-methylstyrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene),poly(ethylacrylate-isoprene), poly(propylacrylate-isoprene), poly(butylacrylate-isoprene), poly(styrene-butadiene-acrylic acid), poly(styrene-butadiene-methacrylic acid), poly(styrene-butylmethacrylate-acrylic acid), and poly(styrene-butylacrylate-acrylic acid).

20. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol for both latexes.

21. A process in accordance with claim 1 wherein the anionic surfactant is selected from the group consisting of sodium dodecyl sulfate, sodium dodecylbenzene sulfate and sodium dodecylnaphthalene sulfate.

22. A process in accordance with claim 2 wherein the ionic surfactant is a cationic surfactant of a quaternary ammonium salt.

23. A process in accordance with claim 1 wherein the pigment is carbon black, magnetite, blue, green, brown, cyan, yellow, magenta, or mixtures thereof.

24. A process in accordance with claim 1 wherein the resin utilized in a first latex and a second latex (ii) is from about 0.01 to about 3 microns in average volume diameter; and the pigment particles are from about 0.01 to about 3 microns in volume average diameter.

25. A process in accordance with claim 1 wherein the toner particles isolated are from about 2 to about 15 microns in average volume diameter, and the geometric size distribution thereof is from about 1.10 to about 1.30.

26. A process in accordance with claim 1 wherein the aggregates formed in (iv) are about 1 to about 10 microns in average volume diameter.

27. A process in accordance with claim 1 wherein the nonionic surfactant concentration selected is an amount of from about 0.1 to about 5 weight percent; the anionic surfactant concentration is about 0.1 to about 5 weight percent; and the cationic surfactant concentration is about 0.1 to about 5 weight percent of the toner components of resin, pigment and charge agent.

28. A process in accordance with claim 1 wherein there is added to the surface of the toner obtained metal salts, metal salts of fatty acids, silicas, metal oxides, or mixtures thereof in an amount of from about 0.1 to about 10 weight percent of the obtained toner particles.

29. A process in accordance with claim 1 wherein the toner is washed with warm water, and the surfactants are removed from the toner surface, followed by drying.

30. A process in accordance with claim 1 wherein the toner particles isolated are from about 3 to about 15 microns in average volume diameter, and the geometric size distribution thereof is from about 1.15 to about 1.27.

31. A process in accordance with claim 1 wherein the electrostatically bound aggregate particles formed in (iv) are from about 1 to about 10 microns in average volume diameter.

32. A process in accordance with claim 2 wherein the nonionic surfactant concentration is about 0.1 to about 5 weight percent of the toner components; and wherein the anionic surfactant concentration is about 0.1 to about 5 weight percent of the toner components.

33. A process in accordance with claim 2 wherein the toner is washed with warm water, and the surfactants are removed from the toner surface, followed by drying.

34. A process in accordance with claim 1 wherein said resin of (ii) is submicron in average volume diameter, the sheared blends of (iii) are continuously stirred, and subsequent to (vi) said toner is separated by filtration and subjected to drying.

35. A process for the preparation of toner particles with a particle size of from about 1 to about 25 microns in average volume diameter comprising:

(i) preparing a pigment dispersion in water, which dispersion is comprised of a pigment with a diameter of from about 0.01 to about 1 micron, and an ionic surfactant;

(ii) mixing at least two latexes comprised of resins of different molecular composition, molecular weight or Tg, ionic and nonionic surfactants and optionally a charge control agent, and wherein the ionic surfactant employed has countercharging characteristics with reference to the ionic surfactant of (i);

(iii) shearing the pigment dispersion with a mixture of the latex blend (ii) comprised of resins, a counterionic surfactant with a charge polarity of opposite sign to that of said ionic surfactant and a nonionic surfactant, and wherein said blend is submicron in size of from about 0.01 to about 1 micron, thereby which shearing enables a flocculation or heterocoagulation of the formed particles of pigment, and resin to form a uniform dispersion of solids in the water and surfactant;

(iv) heating the above sheared blend at a temperature of from about 5° to about 20° C. below the Tg of the resins to form electrostatically bound toner size aggregates with a narrow particle size distribution; followed by the addition of further anionic surfactant;

(v) heating the electrostatically bound toner size aggregate particles at a temperature of from about 5° to about 50° C. above the Tg of the resins to provide a mechanically stable toner composition comprised of polymeric resin and pigment; and optionally (vi) separating said toner particles; and (vii) drying said toner particles.

36. A process in accordance with claim 1 wherein heating in (iv) is from about 5° C. to about 25° C. below the Tg.

37. A process in accordance with claim 1 wherein heating in (iv) is accomplished at a temperature of from about 29° to about 59° C.

38. A process in accordance with claim 1 wherein the resin Tg in (iv) is from about 50° to about 80° C.

39. A process in accordance with claim 1 wherein heating in (vi) is from about 5° to about 50° C. above the Tg.

40. A process in accordance with claim 1 wherein the resin Tg in (vi) is from about 50° to about 80° C.

41. A process in accordance with claim 1 wherein the resin Tg is 54° C. and heating in (vi) is from about 59° to about 104° C.

42. A process in accordance with claim 1 wherein the resin Tg in (iv) is from about 52° to about 65° C.; and the resin Tg in (vi) is from about 52° to about 65° C.

43. A process in accordance with claim 35 wherein the heating in (v) is equal to or slightly below the resin Tg.

44. A process in accordance with claim 35 wherein the heating in (iv) is equal to or slightly above the resin Tg.

45. A process in accordance with claim 1 wherein the toner resulting has a gloss of from about 40 to about 80 gloss units at temperatures below the minimum fixing temperature of the toner, and fixing characteristics in the range of from about 1.6 to about 2.0 units.

46. A process in accordance with claim 1 wherein the toner resulting has excellent fixing characteristics in the range of 1.6 to 2.0 units.

47. A process for the preparation of toner compositions comprising:

(i) preparing a pigment dispersion comprised of pigment, ionic surfactant, and optional charge control agent;

(ii) preparing a latex blend of two or more latexes containing resins of different molecular composition, molecular weight or Tg with a polytron or a mixer operating for a period of from about 0.5 to 2 minutes to obtain a latex blend;

(iii) shearing said pigment dispersion with the latex blend (ii) comprised of resins, a counterionic surfactant with a charge polarity of opposite sign to that of said ionic surfactant and a nonionic surfactant;

(iv) heating the above sheared blends of (iii) below about the glass transition temperature (Tg) of the resins to form electrostatically bound toner size aggregates with a narrow particle size distribution;

(v) subsequently adding further anionic surfactant solution to minimize further growth of the aggregates in the coalescence step (vi); and (vi) heating said bound aggregates above about the Tg of the resins.

48. A process for the preparation of toner comprising:

(i) preparing a pigment dispersion comprised of pigment, ionic surfactant, and optional charge control agent;

(ii) mixing a first and a second latex, each latex comprising a resin of different molecular composition, molecular weight or Tg from the resin of the other latex, ionic and nonionic surfactants and optionally a charge control agent, and wherein the ionic surfactant possesses a countercharge opposite to that of said ionic surfactant used in (i) and wherein a latex blend results;

(iii) shearing said pigment dispersion with the latex blend of (ii) comprised of resins, a counterionic surfactants with a charge polarity of opposite sign to that of said ionic surfactant and a nonionic surfactant;

(iv) heating the above sheared blends below about the glass transition temperature (Tg) of the latex resins to form electrostatically bound toner size aggregates with a narrow particle size distribution;

(v) subsequently adding further an ionic surfactant solution to minimize further growth of the aggregates in the coalescence step (vi);

(vi) heating said bound aggregates above about the Tg of the latex resins to form stable toner particles; and optionally (vii) separating the toner particles from the aqueous medium by filtration, washing the toner to remove traces of surfactant, and drying to produce an electrophotographic toner.

* * * * *